United States Patent [19]

Gannon

[11] Patent Number: 4,712,249

[45] Date of Patent: Dec. 8, 1987

[54] VALVES

[75] Inventor: Raymond Gannon, London, United Kingdom

[73] Assignee: FGL Projects Limited, London, United Kingdom

[21] Appl. No.: 828,057

[22] Filed: Feb. 10, 1986

[30] Foreign Application Priority Data

Feb. 12, 1985 [GB] United Kingdom ..... 8503545
Oct. 30, 1985 [GB] United Kingdom ..... 8526700

[51] Int. Cl.[4] ..... B65D 33/24
[52] U.S. Cl. ..... 383/43; 383/45; 383/100
[58] Field of Search ..... 383/43, 44, 45, 50, 383/51, 100, 103, 905

[56] References Cited

U.S. PATENT DOCUMENTS

| | | | |
|---|---|---|---|
| 3,367,380 | 2/1968 | Dickey | 383/43 |
| 3,904,107 | 9/1975 | Nishimura | 383/45 |
| 3,989,182 | 11/1976 | Stearley | 383/45 |
| 4,252,238 | 2/1981 | Spiegelberg et al. | 383/43 |
| 4,524,460 | 6/1985 | Twiehoff et al. | 383/45 |

*Primary Examiner*—Willis Little
*Attorney, Agent, or Firm*—Henry Sternberg; Bert J. Lewen

[57] ABSTRACT

A valve which is to be used as a component of plastics bags and trays for packaging foodstuffs and other perishable goods. The valve consists essentially of a small spherical chamber having an inlet and an outlet. The chamber is made from two hemi-spherical walls having different resilience. In order to close the valve one wall is made to spring into contact with the other wall so that the two walls enter into such close intimate contact that communication between the inlet and the outlet through the valve is prevented.

8 Claims, 8 Drawing Figures

VALVES

This invention relates to inexpensive valves for containers such as bags for use in the preservation of perishable goods such as foodstuffs and to improved containers incorporating the valves.

Foodstuffs are generally kept preserved in bulk storage until the time approaches when they are required to be used. At this stage the goods are then broken down into small portions and often repacked in vapour impermeable containers such as bags or boxes having walls made of synthetic thermoplastics materials. In accordance with this procedure there is always a danger that during the period between the goods leaving the bulk store and reaching the consumer they will deteriorate seriously or, at least, lose a major part of their original freshness. The preservation of perishable goods is known to be improved markedly if air is removed from the packaged goods or replaced by certain gases for example carbon dioxide which are known to exert preserving effects. Such packaging operations require expensive and sophisticated equipment and in general they are practised only under factory conditions. Nevertheless there is an increasing need for the preservation of food in relatively small quantities without resource to freezing in various types of establishments such as hotels, hospitals, super-markets small shops and even in domestic homes. Considerable advantages can be gained if food can be prepared for even as such short periods as one or two days before it is required to be consumed whilst retaining the major part of its original freshness.

One of the requirements for a packaging process which can be operated satisfactorily in the kind of establishments mentioned above is an inexpensive valve which is to form part of the package and which permits access to its contents. The function which is required to be performed by the valve will depend upon the nature of the goods which are to be packaged. Thus when the goods are liquids such as wine or sterile water packed in a bag made of plastics material the valve is likely to be required to act as a stop-cock enabling portions of the liquid to be withdrawn periodically at a controlled rate from the bag without permitting ingress of air. In other instances where the goods are to be preserved by vacuum packaging or gas injection the valve may be required to act solely as a seal when the air has been extracted from the package or preserving gas injected. Various types of valves have been proposed. However in general they are either too expensive, inconvenient to use or they are insufficiently reliable. This invention is directed to a valve which is both inexpensive to manufacture and versatile in operation.

Accordingly this invention provides a valve for use in the packaging of perishable goods comprising a chamber having two walls and an inlet and an outlet disposed obliquely with respect to each other on either of the walls and one of the walls being deformable resiliently in the direction of the other wall and when deformed in deformable wall enters into such close intimate contact with the other wall that communication between the inlet and the outlet within the valve is prevented. Unless the text indicates otherwise the term 'wall' which is used in this description shall be taken to include 'wall section'.

This invention is illustrated but not restricted by the following drawings in which.

Figure 1:
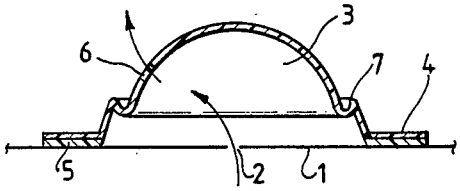
FIG. 1 illustrates a view taken in vertical section of one form of invention valve which is in the open position.
Figure 2:
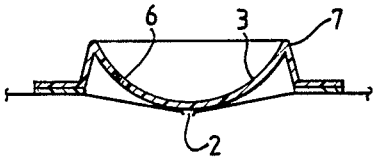
FIG. 2 is a view of the same valve shown in FIG. 1 in the closed position.

In FIG. 1 a wall (1) of a bag (not shown) filled with foodstuffs is provided with an aperture (2) which communicates with a chamber (3) of a valve. The chamber is formed by a sheet of nylon or polycarbonate having a thickness of 2 mm. and is in the shape of a dome having an annular shaped flange (4) by which the valve is bonded by a layer of adhesive (5) to the wall (1) of the bag. If desired the bonding can be effected by heat sealing. The valve is also provided with an aperture (6) which is located in wall of the valve in a position oblique to aperture (2) and a S shaped fold (7) which acts as a form of spring.

In operation foodstuffs are placed in the bag which is then closed in the usual way and with the valve in the open position aperture (6) is then connected to a source of vacuum and air is extracted from the package through apertures (2 and 6). When the desired degree of vacuum has been achieved and whilst the source of vacuum continues to be connected to aperture (6) the bag in the region of aperture (2) is supported on a hard surface and pressure is applied to the top of the dome. Initially the pressure is resisted by spring (7). However a stage is reached when curvature of the dome wall becomes inverted and the wall presses against aperture (2) effectively preventing communication between the two apertures. When this inversion has taken place spring (7) ensures that the wall of the valve surrounding aperture (2) is pressed tightly against opposing wall (3).

Figure 3:
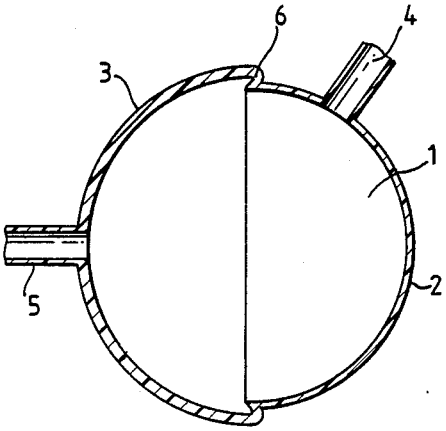
FIG. 3 shows a view taken in vertical section of another form of invention valve which can be used as a stop-cock. The view shows the valve in an open position.
Figure 4:
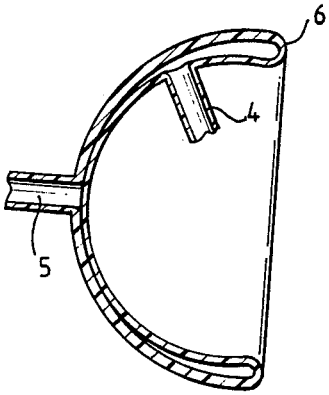
FIG. 4 shows in vertical section the same valve shown in FIG. 3 in the closed position.
Figure 5:
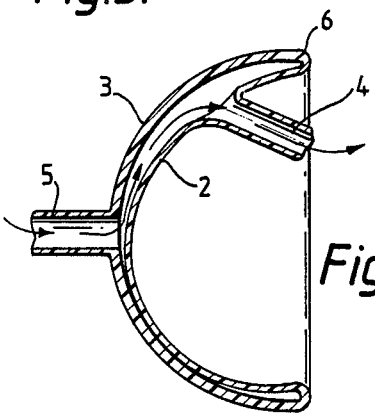
FIG. 5 shows the same valve shown in FIGS. 2 and 3 in a partially open position.

FIGS. 3 to 5 illustrate a form of valve which can be used as a stop-cock. In these figures a chamber (1) is formed by two hemispherical cups (2 and 3) made from sheets of nylon or polycarbonate plastics material separated by a Z shaped kink (6) which acts as a spring. Cup (2) is more readily defromable than cup (3) and has a wall thicknes of about 2 mm. Whilst cup (3) which is less deformable has a wall thickness of about 5 mm. Inlet member (5) is connected to a plastics bag (not shown) which is filled with a liquid. When the bag is filled wall (2) is deformed until the resistnace of spring (6) is overcome and curvature inversion takes place so that wall (2) is brought into such close intimate contact with wall (3) effectively preventing the liquid from flowing through the valve. However if a portion of the liquid is required to be drawn from the bag this can be achieved by bending outlet member (4) in an anticlockwise direction. This has the effect of lifting wall (2) away from wall (3) so that communication is re-established between the two apertures thus allowing the liquid to flow. The flow can be arrested merely be releasing the pressure of member (4) which because of the resilience of the material of which it is made returns to its original position thus eliminating the channel which had been formed temporarily between the two walls. This valve is essentially of a 'fail safe' variety in that once wall (2) has been deformed to bring it into contact with wall (3) the natural position of the valve is in the closed position and liquid can only flow when an anti-clockwise pressure is maintained on apertured member (4).

Valves according to the present invention comprise preferbly two flexible walls having different resilience. The wall which is to be deformed is required to act like a spring so as to ensure that when the two walls are brought into close intimate contact the springy qualities of the wall which has been deformed ensure that this closeness of contact is maintained even when the interior of the package of which the valve is to form a part is under reduced or elevated pressure. The resilience of the walls depends not only on the nature of the materials forming the walls but also the thickness of the sheets from which the walls have been made. In the case of synthetic polyamides such as nylon, or polycarbonate plastics the walls should have preferably a thickness of about 3–10 mm.

The spring like qualities of the deformable wall can be increased to a marked extent by forming a kink which can take the shape of an S or Z bend in one of the walls and preferably the wall to be deformed. The effect of the kink is to act as a spring which constrains the undeformed wall in its undeformed configuration but which when subjected to deforming forces sufficient to overcome the spring then constrains the deformed wall in its new configuration sufficiently or prevent communication between the inlet and the outlet. The presence of a kink of this nature improves greatly the reliability of the present valves. However in the event of the material forming the valve or the method of construcing the valve does not result in sufficiently close intimate contact between the deformed and undeformed wall other methods can be used to assist in closure of the valve for example the inner surface of at least one of the walls can be treated to be or otherwise present a pressure sensitive adhesive surface. Alternatively the two walss can in certain circumstances be heat sealed together.

Figure 6:
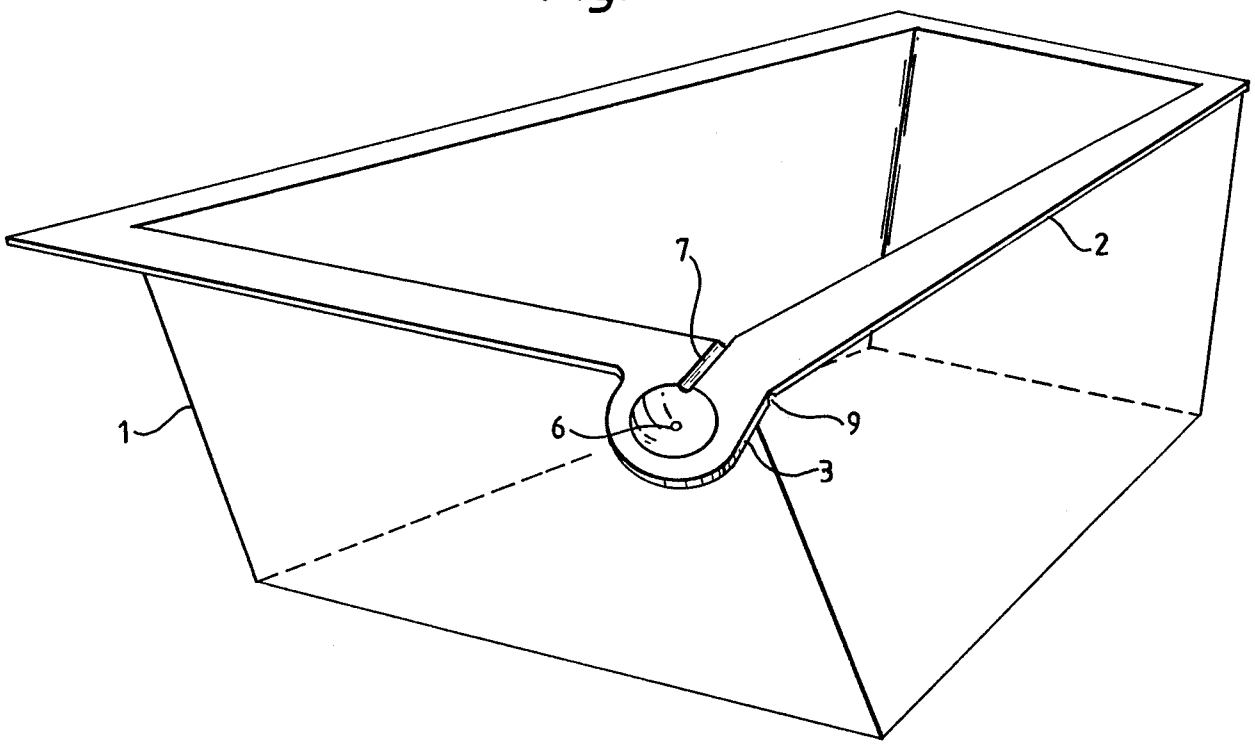
FIG. 6 shows a view in perspective of a container of which invention valve forms a part.
Figure 7:
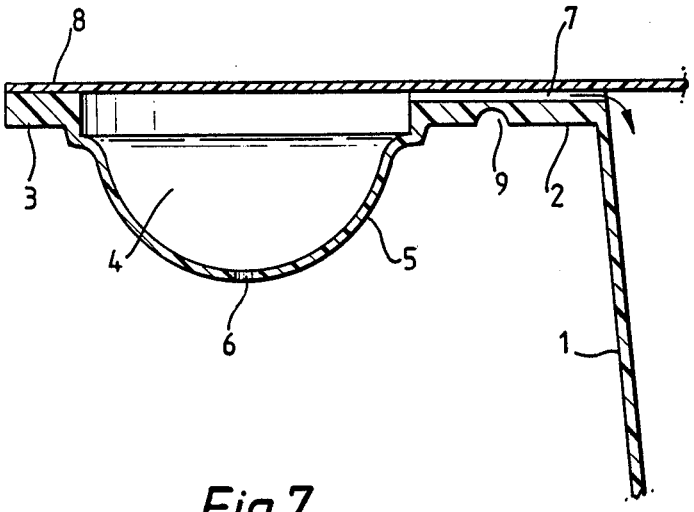
FIG. 7 and FIG. 8 shows the valve illustrated in FIG. 6 respectively in the open and closed positions.
Figure 8:
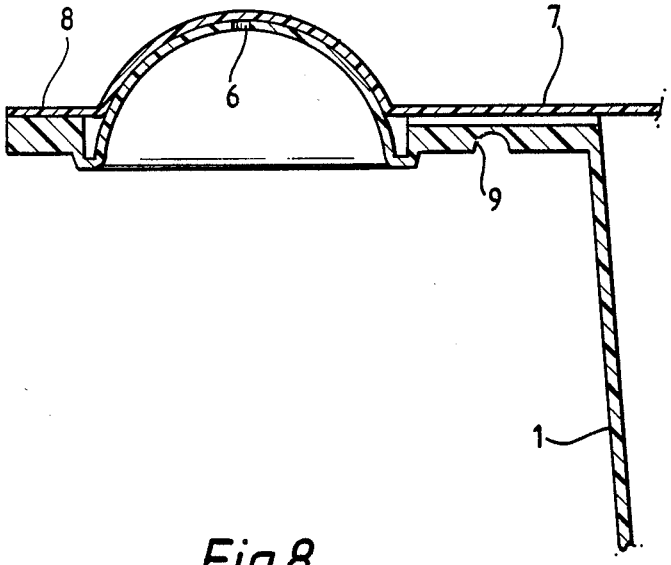

Valves of the present invention can be used to considerable advantage as a component of rigid or semi-rigid trays or other containers which are made by heat moulding. In this process the valve can be incorporated with the tray during its formation. Thus in FIGS. 6 to 8 a container (1), made by heat moulding process, is provided with a flange (2) which extends in one corner of the container to form a lip (3). The lip forms part of a valve shown generally as (4) having a deformable wall (5) having an aperture (6). The interior of valve (4) communicates with the interior of container (1) through channel (7) in the flange. The container is closed conveniently by heat sealing a flexible sheet (8) of thermoplastics materials to the flange (2) and the extension of the flange (3). This sheet therefore also provides the second wall of valve (4).

In operation the goods to be packaged are placed in the container which is then sealed with cover (8). At this state the valve is in the open position depicted in FIG. 7. Air is then pumped out of the container and is replaced by a preseving gas for example nitrous oxide, nitrogen or carbon dioxide The valve is then sealed by pressing wall (5) in the direction of lid (8). When curvature inversion takes place aperture (6) is closed. In order to open the container valve (4) is cut off the container at crack-off (9) and a knife can be inserted in channel (7). The heat weld between the lid and the flange can then be cut thus releasing the lid.

The present valves can be used for the packaging of a wide range of goods apart from foodstuffs which require to be preserved or protected from adverse effects of the atmosphere for example electrical and electronic components and medical samples. In situations where the valves are to be used for the vacuum packaging of goods in plastics bags but which are fragile and have to be protected against crushing by the atmosphere when the air in the bag in which the goods are packed is pumped out, the method described in our copending patent application Nos. 8503545 and 8513385 can be used to good effect. These applications provide in one aspect a process for the packaging of goods comprising placing the goods in an unsealed or partly sealed first container having at least one deformable wall placing the container in a second container having substantially non deformable wall or walls creating simultaneously a vacuum in both containers whilst introducing a preserving or inert gas into the first container and then sealing the first container whilst preventing the entry of undesireable substances.

I claim:

1. A valve for use in the packaging of perishable goods comprising a chamber having two walls and an inlet and an outlet disposed obliquely with respect to each other on either of the walls and one of the walls being deformable resiliently in the direction of the other wall and when deformed the deformable wall enters into such close intimate contact with other wall that communiction between the inlet and the outlet within the valve is prevented.

2. A valve according to claim 1 wherein the walls have different resilience.

3. A valve according to either of claims 1 or 2 wherein a part of a wall is shaped to form a spring.

4. A valve according to claim 3 wherein the spring is S or Z shaped.

5. A valve according to claim 1 or 2 wherein the inner surface of one of the walls is a pressure sensitive adhesive surface.

6. A container incorporating a valve according to claim 1 or 2.

7. A container according to claim 6 comprising a bag made from thermoplastics material wherein a part of the wall thereof constitutes a wall of the valve.

8. A container according to claim 6 comprising a tray having a rigid or semi-rigid walls and a lid comprising a thin deformable sheet both the tray and the sheet comprising thermoplastics material and a part of a wall of the tray and of the lid each constitutes a wall of the valve.

* * * * *